US008205287B2

(12) United States Patent
Rockwell et al.

(10) Patent No.: US 8,205,287 B2
(45) Date of Patent: Jun. 26, 2012

(54) INSULATION ELEMENT FOR AN ELECTRICAL APPLIANCE SUCH AS A DISHWASHER

(75) Inventors: Anthony L. Rockwell, Pickerington, OH (US); Phil Johnson, Louisville, KY (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 319 days.

(21) Appl. No.: 12/534,891

(22) Filed: Aug. 4, 2009

(65) Prior Publication Data

US 2010/0024851 A1 Feb. 4, 2010

Related U.S. Application Data

(60) Provisional application No. 61/086,066, filed on Aug. 4, 2008.

(51) Int. Cl.
*D06F 39/12* (2006.01)

(52) U.S. Cl. ..... 8/158; 68/3 R; 134/42

(58) Field of Classification Search ..... 134/200, 134/42; 68/3 R; 8/158
See application file for complete search history.

(56) References Cited

U.S. PATENT DOCUMENTS

| | | | | |
|---|---|---|---|---|
| 514,663 | A | 2/1894 | Pitt | |
| 2,001,632 | A | 5/1935 | Schlichting | |
| 2,254,837 | A | 9/1941 | Burns | |
| 2,542,840 | A | 2/1951 | Riddle | |
| 3,017,022 | A | 1/1962 | Lee | |
| 3,265,780 | A * | 8/1966 | Long | 264/417 |
| 3,295,541 | A * | 1/1967 | Ummel | 134/182 |
| 3,542,550 | A | 11/1970 | Leonard et al. | |
| 3,557,901 | A | 1/1971 | Young | |
| 3,634,562 | A * | 1/1972 | Kole et al. | 264/41 |
| 3,642,550 | A | 2/1972 | Doll | |
| 3,642,967 | A | 2/1972 | Doll | |
| 3,655,501 | A | 4/1972 | Tesch | |
| 3,673,057 | A | 6/1972 | Fairbanks | |
| 3,806,390 | A | 4/1974 | Balk et al. | |
| 3,819,006 | A | 6/1974 | Westlund | |
| 3,819,007 | A | 6/1974 | Wirt | |
| 3,864,198 | A | 2/1975 | Jackson | |
| 4,001,473 | A | 1/1977 | Cook | |

(Continued)

FOREIGN PATENT DOCUMENTS

DE 26 52 308 * 5/1978

(Continued)

OTHER PUBLICATIONS

International Search Report PCT/US2009/050991 dated Nov. 4, 2009.

(Continued)

*Primary Examiner* — Frankie L Stinson
(74) *Attorney, Agent, or Firm* — Calfee, Halter & Griswold LLP

(57) ABSTRACT

An insulation element is provided for installation in a gap of thickness G provided between two objects. The insulation element includes a body made from a thermoplastic polymer material. The body has a first face, a second face and a thickness defined between the first and second faces. The body is characterized by a semi permanently pre-installation thickness $T_1$ where $T_1$ is less than G. The body swells upon heating to a thickness $T_2$ where $T_2$ is greater than or equal to G so that the insulation element bridges the gap, engages the two objects and provides a spring rate of between 4.0 and 275.0 grams per square inch.

23 Claims, 2 Drawing Sheets

U.S. PATENT DOCUMENTS

| | | | | | |
|---|---|---|---|---|---|
| 4,007,388 | A | | 2/1977 | Lawyer et al. | |
| 4,111,081 | A | | 9/1978 | Hilliard | |
| 4,295,637 | A | | 10/1981 | Hulek | |
| 4,303,747 | A | | 12/1981 | Bender | |
| 4,384,020 | A | | 5/1983 | Beggs | |
| 4,465,725 | A | | 8/1984 | Riel | |
| 4,615,671 | A | | 10/1986 | Bernal | |
| 4,821,839 | A | | 4/1989 | D'Antonio et al. | |
| 4,879,084 | A | | 11/1989 | Parnigoni | |
| 4,901,676 | A | * | 2/1990 | Nelson | 122/19.2 |
| 4,985,106 | A | * | 1/1991 | Nelson | 156/276 |
| 5,044,705 | A | | 9/1991 | Nelson | |
| 5,056,341 | A | | 10/1991 | Mori et al. | |
| 5,110,266 | A | | 5/1992 | Toyoshima et al. | |
| 5,151,018 | A | | 9/1992 | Clendenin et al. | |
| 5,272,285 | A | | 12/1993 | Miller | |
| 5,374,118 | A | | 12/1994 | Kruck et al. | |
| 5,432,306 | A | | 7/1995 | Pfordresher | |
| 5,503,172 | A | | 4/1996 | Hedeen et al. | |
| 5,515,702 | A | | 5/1996 | Park | |
| 5,543,198 | A | | 8/1996 | Wilson | |
| 5,547,743 | A | | 8/1996 | Rumiesz, Jr. et al. | |
| 5,632,543 | A | * | 5/1997 | McGrath et al. | 312/406 |
| 5,705,252 | A | | 1/1998 | Lea et al. | |
| 5,714,107 | A | | 2/1998 | Levy et al. | |
| 5,755,900 | A | | 5/1998 | Weir et al. | |
| 5,897,951 | A | | 4/1999 | Gallagher | |
| 5,965,851 | A | * | 10/1999 | Herreman et al. | 181/200 |
| 6,332,823 | B1 | | 12/2001 | Rouse, Jr. | |
| 6,512,831 | B1 | | 1/2003 | Herreman et al. | |
| 6,539,955 | B1 | * | 4/2003 | Tilton et al. | 134/58 D |
| 6,669,265 | B2 | | 12/2003 | Tilton et al. | |
| 6,673,415 | B1 | | 1/2004 | Yamazaki et al. | |
| 6,736,470 | B2 | | 5/2004 | Manke et al. | |
| 6,793,037 | B1 | | 9/2004 | Babuke et al. | |
| 2002/0010229 | A1 | | 1/2002 | Medoff et al. | |
| 2002/0134615 | A1 | * | 9/2002 | Herreman et al. | 181/290 |
| 2002/0174954 | A1 | * | 11/2002 | Busseuil et al. | 156/349 |
| 2003/0096548 | A1 | | 5/2003 | Groitzsch et al. | |
| 2005/0092353 | A1 | | 5/2005 | Retsema | |
| 2005/0123720 | A1 | | 6/2005 | Suzuki et al. | |
| 2005/0150720 | A1 | | 7/2005 | Tudor et al. | |
| 2006/0008614 | A1 | | 1/2006 | Rockwell | |
| 2006/0008616 | A1 | | 1/2006 | Dean et al. | |
| 2006/0162997 | A1 | | 7/2006 | Cooksey et al. | |
| 2007/0042156 | A1 | | 2/2007 | Rockwell | |
| 2007/0054090 | A1 | | 3/2007 | Rockwell | |
| 2008/0067002 | A1 | | 3/2008 | Pfaffelhuber et al. | |

FOREIGN PATENT DOCUMENTS

| | | | |
|---|---|---|---|
| DE | 42 27 957 | * | 2/1994 |
| DE | 4225278 | | 2/1994 |
| DE | 199 07 146 | | 8/2000 |
| DE | 101 18 632 | * | 10/2001 |
| DE | 101 18 632 | | 10/2002 |
| EP | 0 352 993 | | 1/1990 |
| EP | 0718570 | | 6/1996 |
| EP | 1 277 865 | | 1/2003 |
| EP | 1 772 480 | | 4/2007 |
| EP | 2 022 678 | | 2/2009 |
| FR | 2214932 | | 8/1974 |
| GB | 1515455 | | 6/1978 |
| GB | 2122540 | | 1/1984 |
| JP | 61246542 | | 11/1986 |
| JP | 3237961 | | 10/1991 |
| JP | 8049871 | | 2/1996 |
| WO | WO 2006/017297 | | 2/2006 |
| WO | WO 2006/098745 | * | 9/2006 |

OTHER PUBLICATIONS

International Search Report PCT/US2009/052652 dated Feb. 16, 2010.

Ashley, Marjorie, Grandpa's Flower Garden, "Annie's Pattern Club" Oct.-Nov. 1988, No. 53, pp. 10-13.

International Search Report PCT/US2006/032597 dated Mar. 21, 2007.

International Search Report PCT/US2007/005103 dated Sep. 12, 2007.

* cited by examiner

INSULATION ELEMENT FOR AN ELECTRICAL APPLIANCE SUCH AS A DISHWASHER

This application claims the benefit of U.S. Provisional Patent Application Ser. No. 61/086,066 filed 4 Aug. 2008, the entire disclosure of which is incorporated herein by reference.

TECHNICAL FIELD AND INDUSTRIAL APPLICABILITY OF THE INVENTION

The present invention relates generally to electrical appliance technology and, more particularly, to an insulation element and a method of insulating an electrical appliance to suppress noise and increase the energy efficiency of the appliance.

BACKGROUND OF THE INVENTION

Electrical appliances such as automatic dishwashers have long been known in the art. Automatic dishwashers are a particularly convenient and efficient way to clean dishes following their use. Such dishwashers generally include a tub for holding the dishes and one or more streams of pressurized fluid for washing food and drink residue from the dishes.

The dishwashing process generates a considerable amount of noise. Consumers have shown a preference for dishwashers that provide more quiet operation. In order to address this preference, manufacturers of dishwashers have insulated dishwashers in various ways in an attempt to suppress noise.

One method of noise suppression commonly used today is to apply a mass dampener material such as bitumen and/or mastic to the outside of the tub. A mass dampener material such as mastic can greatly reduce wash noise in the 35-60 Hz range.

The use of mass dampener materials of this type does, however, result in a number of drawbacks. More specifically, the mastic undergoes a bake-on process in order to adhere the mastic to the tub which is usually constructed from stainless steel. This bake-on process often creates variations in the stiffness of the tub thereby resulting in acoustic variations from unit to unit of anywhere up to plus or minus 1.5 Db.

Further, while the mastic is effective in suppressing wash noise in the 35-60 Hz range it does little to suppress pump motor noise at or around 125 Hz-about 400 Hz range. In fact, the application of mastic to the tub can actually cause the tub to "ring" at the motor frequency thereby accentuating motor noise. Furthermore, the mastic may harden over time, and may become less effective as the appliance ages.

The present invention relates to an insulation element and method of insulating an electrical appliance such as a dishwasher that allows one to reduce or eliminate the use of mass dampener materials such as mastic while still effectively suppressing the noise generated during the washing operation. The reduction or elimination of mastic from the side of the tub significantly reduces acoustic variation from unit to unit thereby allowing engineers to produce a more effective noise insulation system for all units. Further, as an added bonus, the present invention also allows the electrical appliance to operate at higher energy efficiency.

SUMMARY OF THE INVENTION

To achieve the foregoing and other objects, and in accordance with the purposes of the present invention as described herein, an improved insulation element is provided. The insulation element is particularly adapted for installation in a gap of thickness G provided between two objects. The insulation element comprises a body made from an expandable material. The body is also characterized by a semi permanently fixed pre-installation thickness of $T_1$ where $T_1$ is less than G. Upon heating, that body swells to a thickness $T_2$ where $T_2$ is equal to or greater than G so that the insulation element bridges the gap, engages the two objects and provides a spring rate of about 4.0 to about 275.0 grams per square inch. In one possible embodiment, the insulation element provides a spring rate of about 10 to about 25 grams per square inch.

In an alternative embodiment, the insulation is first compressed to a thickness $T_1$, which is less than G. After installation in the gap, the compression device is removed and the insulation expands to a thickness $T_2$ greater than G, preferably without the use of heat. A useful compression device includes any known device, such as a pair of opposed paddles.

The expandable material, from which the body is constructed, may be selected from a group of materials consisting of expandable foam material, expandable natural fibers, thermoplastic polymer material, fiberglass reinforced thermoplastic polymer material, cotton, kenaf, hemp, polyester, polyethylene, polypropylene, polyethylene terephthalate, polybutylene terephthalate, rayon, acrylic, nylon and any combinations thereof. The expandable material may also include reinforcing fibers. Typically, the reinforcing fibers are selected from a group consisting of glass fibers, carbon fibers, natural fibers, polyester, recycled fibers and mixtures thereof. Where glass fibers are utilized as the reinforcing fibers, those glass fibers may have a length of between about 0.5" and about 1.5" and a diameter of between about 5 and about 25 microns. Continuous glass fibers may also be utilized. Such continuous glass fibers typically have a diameter of between about 5 and about 50 microns. Where reinforcing fibers are provided in the expandable material, the reinforcing fibers typically comprise between about 20 and about 80 weight percent, while the expandable material comprises between about 80 and about 20 weight percent of the composition of the body.

In accordance with another aspect of the present invention, a dishwasher is provided. The dishwasher comprises a tub including an access door, a washing nozzle inside the tub for directing a fluid stream against dishes held in the tub, a circulation pump for circulating fluid under pressure through the washing nozzle, and an insulation element for installation in a gap of thickness G provided between the tub and a cabinet that receives the tub. The insulation element comprises a body made from an expandable material. The body is characterized by a semi permanently fixed pre-installation thickness of $T_1$ where $T_1$ is less than C. The body swells upon heating to a thickness of $T_2$ where $T_2$ is equal to or greater than G, so that the insulation element bridges the gap, engages the tub and cabinet and provides a spring rate of between 4.0 and 275.0 grams per square inch.

In accordance with yet another aspect of the present invention, a method is provided for suppressing noise generated by an electrical appliance held in a cabinet wherein a gap of thickness G is provided between a housing wall of the electrical appliance and the cabinet. The method comprises the steps of: (1) selecting an expandable material capable of (a) swelling in response to heat generated by the electrical appliance during normal operation of the electrical appliance and (b) providing a spring rate of between about 4.0 and about 275.0 grams per square inch when bridging the gap and engaging the housing wall and the cabinet; (2) forming an insulation element from the expandable material wherein the insulation element is compressed to a semi permanent thickness $T_1$ where $T_1$ is less than G; and (3) installing the insulation element on the housing wall of the electrical appliance. After installation of the electrical appliance in the cabinet, operation of the electrical appliance heats the insulation element, causing the insulation element to expand/swell to a thickness $T_2$ where $T_2$ is equal to or greater than G. When this occurs, the insulation element bridges the gap and engages the housing wall and the cabinet, thereby establishing the necessary spring rate to suppress or eliminate noise generated by the electrical appliance at peak or predominant frequencies.

The method may further include the tuning of the spring rate provided by the insulation element in order to match the acoustic properties of the electrical appliance, and thereby optimize noise suppression at the peak or predominant frequencies. In one particularly useful embodiment, the spring rate is tuned to be between about 10.0 and about 25.0 grams per square inch.

Still other objects of the present invention will become readily apparent to be skilled in this art from the following description, wherein there is shown and described several embodiments of this invention, simply by illustration of some of the modes best suited to carry out the invention. As it should be realized, the invention is capable of other different embodiments and its several details are capable of modification in various, obvious aspects, all without departing from the invention. Accordingly, the drawing and descriptions will be regarded as illustrative in nature and not as restrictive.

BRIEF DESCRIPTION OF THE DRAWINGS

The accompanying drawing incorporated herein and forming a part of the specification, illustrates several aspects of the present invention, and together with the description serves to explain certain principles of the invention. In the drawings.

Reference will now be made in detail to the present preferred embodiment of the invention, an example which is illustrated in the accompanying drawing.

DETAILED DESCRIPTION OF THE PREFERRED EMBODIMENTS OF THE INVENTION

Figure 1:
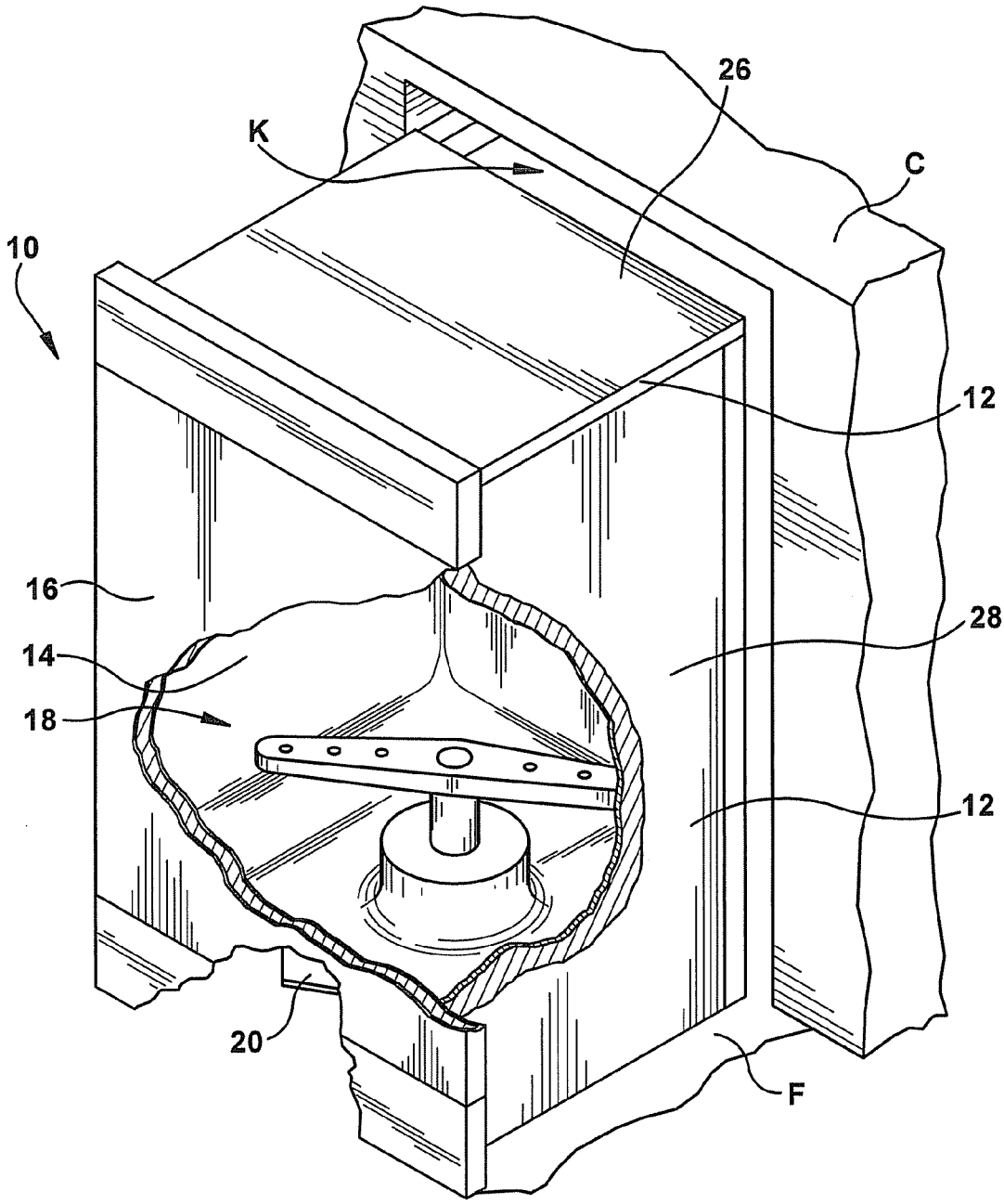
FIG. 1 is a schematical and partially cut away perspective view of a dishwasher incorporating the insulation element of the present invention.

Reference is now made to FIG. 1 illustrating a dishwasher 10 incorporating the insulation element 12 of the present invention. The dishwasher 10 includes a tub 14 having a door 16. The door 16 may be opened in order to gain access to the interior or washing chamber 18 of the tub 14 into which dishes are placed for washing. The illustrated dishwasher 10 is an under-the-counter design, suitable for insertion and mounting in a cavity K formed in a kitchen cabinet C. The tub 14 may be made of a plastic, a composite or a metal such as stainless steel.

The dishwasher 10 also includes a circulation pump 20. The circulation pump 20 circulates fluid such as wash water, from a supply line to a washing nozzle 24, provided in the washing chamber 18. The washing nozzle 24 directs a fluid stream against the dishes held in the washing chamber 18 so as to scrub and lift food and drink residue from the dishes and provide the desired cleaning action. A drain line discharges fluid entrained with food and drink residue and debris from the washing chamber 18.

As best illustrated in FIG. 1, the insulating element 12 covers at least the top 26 and the opposed left and right sides 28 of the dishwasher 10. The insulating element 12 may comprise one or more individual sections. Typically the sections of the element 12 covering the sides 28 extend all the way to the floor F. If desired, the insulating element 12 may also be provided across the back or rear of the dishwasher 10.

The insulating element 12 comprises a body 30 that is made from an expandable material. That expandable material may be selected from a group of materials consisting of expandable foam material, expandable natural fibers, thermoplastic polymer material, fiberglass reinforced thermoplastic polymer material, cotton, kenaf, hemp, polyester, polyethylene, polypropylene, polyethylene terephthalate, polybutylene terephthalate, rayon, acrylic, nylon and any combinations thereof. The thermoplastic polymer material may be selected from a group of materials consisting of polyester, polyethylene terephthalate, polybutylene terephthalate and mixtures thereof. The expandable material may also include reinforcing fibers. Where reinforcing fibers are provided, those fibers are selected from a group consisting of glass fibers, carbon fibers, natural fibers, polyester, recycled fibers and mixtures thereof. Where glass fibers are utilized, they typically have a length of between about 0.5" and about 1.5", and a diameter of between about 5 and about 25 microns. Alternatively, continuous glass fibers may be utilized having a diameter of about 5 and about 50 microns. In one possible application, a thermoplastic polymer material includes between about 20 and about 80 weight percent reinforcing fibers and between about 80 and about 20 weight percent polymer matrix binder.

Figure 2A:
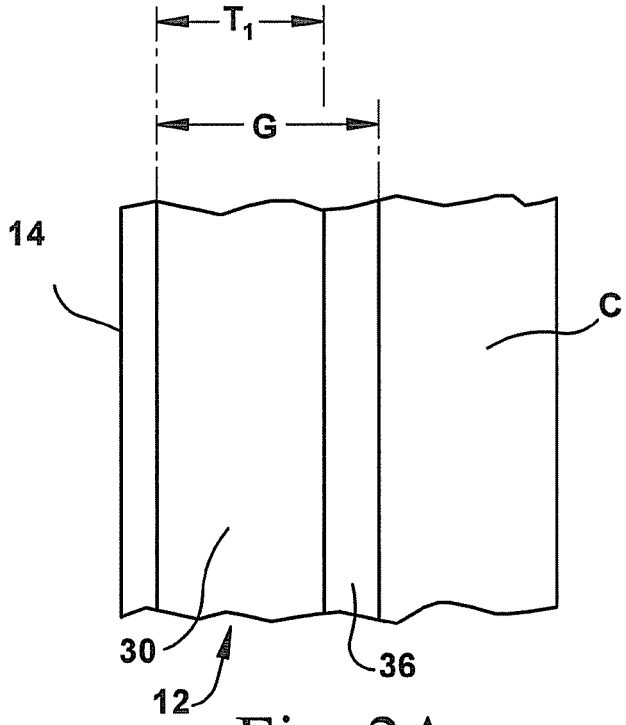
FIGS. 2A and 2B are schematical cross sectional views illustrating the installation and ultimate swelling of the insulation so that the insulation element bridges the gap between two objects and provides the necessary spring rate for suppressing noise generated by an electrical appliance.

As best illustrated in FIG. 2A, when installed a gap 36 exists between the housing wall or outer surface of the tub 14 and the face of the cabinet C. As illustrated, the gap has a thickness G. At the time of installation, the body 30 of the insulating element 12 is characterized by a semi permanently fixed pre-installation thickness of $T_1$ where $T_1$ is less than G. The smaller thickness of the insulating element 12 insures that sufficient clearance exists to easily install the dishwasher in the cabinet C.

Figure 2B:
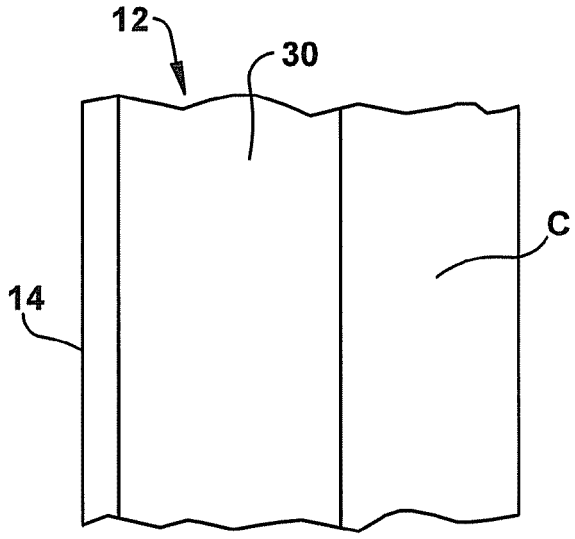

When the dishwasher 10 is operated after installation, the insulating element 12 is heated by the dishwasher. As a result, the body 14 swells to a thickness $T_2$ where $T_2$ is equal to or greater than G. Thus, as illustrated in FIG. 2B, the insulation element 12 now bridges the gap 36, engages the outer wall of the tub 14 and the face of the cabinet C, and functions as a spring, providing a spring rate of about 4.0 to about 275.0 grams per square inch.

The present invention also includes a method of suppressing noise generated by a dishwasher 10 held in a cabinet C when a gap 36 of thickness G is provided between a tub 14 of the dishwasher and the cabinet. The method includes the step of selecting an expandable material capable of (a) expanding/swelling in response to heat generated by the dishwasher during normal operation of the dishwasher and (b) providing a spring rate of about 4.0 to about 275.0 grams per square inch when bridging the gap between the tub and the cabinet. In one particularly useful embodiment, the spring rate provided is between about 10.0 and about 25.0 grams per square inch.

The method further includes the step of forming an insulation element from the expandable material when the insulation element is compressed to a semi permanent thickness $T_1$ wherein $T_1$ is less than G. One particularly useful method for compressing the insulating element 12 is described in U.S. Pat. No. 7,357,974 to Rockwell.

The method also includes the step of installing the insulation element 12 on the tub 14 of the dishwasher 10. This may be done with adhesive, mechanical fasteners or other appropriate means. After installation of the dishwasher 10 in the cabinet C, operation of the dishwasher heats the insulation element 12, causing the insulation element to swell to a thickness $T_2$ where $T_2$ is equal to or greater than G (See FIG. 2B) so that the insulation element bridges the gap 36 and engages the tub 14 and the cabinet C, and thereby acts as a spring and suppresses noise generated by the dishwasher. In addition, the method includes a step of increasing the energy efficiency of the dishwasher 10 by at least 10 percent.

More particularly, the method may further include the tuning of the spring rate to match the acoustic characteristics of the electrical appliance or dishwasher 10 so as to more effectively suppress or eliminate at least one peak or predominant frequency of noise generated during dishwasher operation. Such tuning determines the amount of energy and the frequencies to be dissipated.

Advantageously, the insulating element 12 is so effective in suppressing dishwasher noise that less mass dampener material, (e.g. mastic), may be used while still obtaining an equivalent or even greater amount of overall noise suppression. More specifically, the application of mass dampener material may be limited to the top wall 26 and/or front door 16 of the tub 14. Mass dampener material contacting a tub 14 acts as a heat sink, drawing heat from the washing chamber 18 including the wash water and dishes. Since the present invention allows the use of far less mass dampener material, this heat sink effect is dramatically reduced. As a result, dishwasher cycle times are reduced by at least 10 percent. In fact, testing completed to date, has demonstrated energy savings of up to 28 percent on certain model dishwashers. This is before optimizing energy savings by, for example, substituting smaller heating coils for the drying cycle. Such substitution is possible since the use of less mastic means less heat is being drawn by mastic from the washing chamber 18. In one embodiment, the instant invention was used in combination with a mastic that extended only six inches from the front of the appliance so when the spray hits the tub at this location, the mastic acts as a local damper. It has further been found that an insulation element 36 tuned to provide a spring rate of about 15.0 grams per square inch is particularly effective in reducing/eliminating noise at the predominate 125 hertz frequency when used on a stainless steel tub 14 even without any mastic.

Numerous benefits result from the employing of the concepts of the present invention. The insulating element 12 provides improved overall noise suppression which allows the manufacturer to limit or even eliminate the use of mass dampener material and still maintain the equivalent or provide improved noise suppression performance. Reduction or elimination of mass dampener material means a reduction of the overall weight of a dishwasher 10. This reduces shipping costs and allows the dishwasher to be more easily handled during installation. The reduction or elimination of mastic also results in an acoustic decrease in the predominant 125 Hz-about 400 Hz range. The 125 Hz is generated by the pump motor and is the main contributor to dishwasher noise. As a consequence, such a reduction is a very significant benefit. Additionally, the thickness of the wall of the dishwasher tub may be reduced, and the invention has provided surprising results even with a reduction in wall thickness. In one embodiment, the wall of a stainless steel tub was reduced from 0.172 inches thick to 0.152 inches, using the instant invention without mastic, and achieving improved acoustics. Similarly, the invention was shown to be effective on plastic tubs. Furthermore, the instant invention does not harden with age, and retains its performance over time. In some instances, the effectiveness improves with age, as the appliance goes through repeated heating cycles with the instant invention.

Since mass dampener material provided on the tub 14 of a dishwasher 10 acts like a heat sink to draw heat from the washing chamber 18, the reduction or elimination of mass dampener material provided by the present invention also advantageously serves to reduce cycle times and increase energy efficiency. More specifically, since less heat is transferred from the washing chamber 18 to the mastic outside the chamber, the dishwasher cycles to predetermined minimum operating temperatures more quickly. Cycle times are reduced and less energy is consumed. Accordingly, the present invention leads to a number of very important benefits. Thus, it is clear that the present invention represents a significant advance in the art.

The foregoing description of several preferred embodiments of the present invention have been presented for purposes of illustration and description. It is not intended to be exhaustive or to limit the invention to the precise form disclosed. Obvious modifications or variations are possible in light of the above teachings. For example, some models of dishwashers 10 include an outer housing outside of the tub 14. The insulating element 12 may be provided to bridge the gap between the tub and such an outer housing in the same manner the insulating element is provided in the illustrated embodiment to bridge the gap between the tub and the kitchen cabinet C. The net effect is to provide an insulating element characterized by a spring rate of between 4.0 and 275.0 grams per square inch that provides noise suppression at the desired peak or predominant frequencies.

Still further, it should be appreciated that the expandable insulation element 12 may be compressed with paddles or other means to a thickness $T_1$ during installation in a gap of thickness G where $T_1$ is less than G. After installation, the compression force is removed and the insulation element 12 expands to a thickness $T_2$ where $T_2$ is greater than or equal to G. The insulation element 12 then effectively bridges the gap between, for example, an appliance housing and a cabinet receiving the appliance. As a result, the insulation element 12 provides a spring rate effective to reduce or eliminate operating noise.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. An insulation element for installation in a gap of thickness G provided between a housing wall of an electrical appliance and a cabinet, said insulation element comprising:

a body made from an expandable material; said body being characterized by a semi permanently fixed pre-installation thickness of $T_1$ where $T_1$ is less than G, said body being configured to swell in response to heat generated by said electrical appliance during normal operation of the appliance to a thickness $T_2$ where $T_2$ is greater than or equal to G; so that said insulation element bridges said gap to engage the housing wall of the electrical appliance and the cabinet.

2. The insulation element of claim 1, wherein said expandable material is selected from a group of materials consisting of expandable foam material, expandable natural fibers, thermoplastic polymer material, fiberglass reinforced thermoplastic polymer material, cotton, kenaf, hemp, polyester, polyethylene, polypropylene, polyethylene terephthalate, polybutylene terephthalate, rayon, acrylic, nylon and any combinations thereof.

3. The insulation element of claim 1 wherein said expandable material is a thermoplastic polymer material.

4. The insulation element of claim 3, wherein said thermoplastic polymer material is selected from a group of materials consisting of polyester, polyethylene terephthalate, polybutylene terephthalate and mixtures thereof.

5. The insulation element of claim 4 wherein said thermoplastic polymer material includes reinforcing fibers.

6. The insulation element of claim 5, wherein said reinforcing fibers are selected from a group consisting of glass fibers, carbon fibers, natural fibers, polyester, recycled fibers and mixtures thereof.

7. The insulation element of claim 6, wherein said glass fibers have a length of between about 0.5 inches and about 1.5 inches and a diameter of between about 5 and about 25 microns.

8. The insulation element of claim 6, wherein said glass fibers are continuous fibers having a diameter of between about 5 and about 25 microns.

9. The insulation element of claim 5, wherein said thermoplastic polymer material includes between about 20 and about 80 weight percent reinforcing fibers and between about 80 and about 20 weight percent polymer matrix binder.

10. The insulation element of claim 1, wherein said insulation element provides a spring rate of between about 10.0 and about 25.0 grams per square inch.

11. The insulation element of claim 1 wherein the electrical appliance is a dishwasher and wherein the amount of energy required for the dishwasher to complete a wash cycle is reduced by at least 10 percent when said insulation element bridges said gap.

12. A method of suppressing noise generated by an electrical appliance held in a cabinet wherein a gap of thickness G is provided between a housing wall of said electrical appliance and said cabinet, said method comprising:

selecting an expandable material capable of (a) swelling in response to heat generated by said electrical appliance during normal operation of said electrical appliance and (b) providing a spring rate of between about 4.0 and about 275.0 grams per square inch when bridging said gap and engaging said housing wall and said cabinet;

forming an insulation element from said thermoplastic polymer material wherein said insulation element is compressed to a semi permanent thickness $T_1$ where $T_1$ is less than G; and installing said insulation element between said housing wall of said electrical appliance and the cabinet;

whereby after installation of said electrical appliance in said cabinet, operation of said electrical appliance heats said insulation element causing said insulation element to swell to a thickness $T_2$ where $T_2$ is equal to or greater than G so that said insulation element bridges the gap and engages said housing wall and said cabinet.

13. The method of claim 12, including providing a spring rate of between about 10.0 and about 25.0 grams per square inch.

14. The method of claim 12, further including tuning said spring rate to match acoustic characteristics of said electrical appliance so as to more effectively suppress at least one predominant noise frequency generated by said electrical appliance.

15. The method of claim 12, including limiting application of mass dampener material to a top wall of said tub.

16. The method of claim 12, including limiting application of mass dampener material to a front side of said tub.

17. The method of claim 12, including limiting application of mass dampener material to a top wall and a front door of said tub.

18. The method of claim 17, including using mastic as said mass dampener material.

19. The method of claim 12, wherein said electrical appliance is a dishwasher and wherein said method reduces the amount of energy required for the dishwasher to complete a wash cycle by at least 10 percent.

20. The method of claim 12, including completely eliminating application of a mass dampener material to said tub.

21. A dishwasher, comprising:

a tub including an access door; a washing nozzle inside said tub for directing a fluid stream against dishes held in said tub;

a circulation pump for circulating fluid under pressure through said washing nozzle; and an insulation element for installation in a gap of thickness G provided between said tub and a cabinet that receives said tub, said insulation element comprising: a body made from an expandable material; said body being characterized by a semi permanently fixed pre-installation thickness of $T_1$ and where $T_1$ is less than G, said body swelling in response to heat generated by said electrical appliance during normal operation of the appliance to a thickness $T_2$ where $T_2$ is greater than or equal to G so that said insulation element bridges said gap, engages the tub and the cabinet and provides a spring rate of between about 4.0 and about 275.0 grams per square inch.

22. The dishwasher of claim 21 wherein the amount of energy required for the dishwasher to complete a wash cycle is reduced by at least 10 percent when said insulation element bridges said gap.

23. A dishwasher, comprising:

a tub including an access door;

a washing nozzle inside said tub for directing a fluid stream against dishes held in said tub;

a circulation pump for circulating fluid under pressure through said washing nozzle; and an insulation element for installation in a gap of thickness G provided between said tub and a cabinet that receives said tub, said insulation element comprising: a body made from an expandable material; said body being characterized by a semi permanently fixed pre-installation thickness of $T_1$ and where $T_1$ is less than G, said body swelling in response to heat generated by said electrical appliance during normal operating of the appliance upon heating to a thickness $T_2$ where $T_2$ is greater than or equal to G so that said insulation element bridges said gap, engages the tub and the cabinet and provides a spring rate of between about 4.0 and about 275.0 grams per square inch;

said insulation element being used in substantial absence of a mass dampener material.

* * * * *